United States Patent [19]

Stahlecker et al.

[11] Patent Number: 4,768,336

[45] Date of Patent: Sep. 6, 1988

[54] ARRANGEMENT FOR PNEUMATIC FALSE-TWIST SPINNING

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 105,816

[22] Filed: Oct. 8, 1987

[30] Foreign Application Priority Data

Oct. 10, 1986 [DE] Fed. Rep. of Germany ..... 3634557

[51] Int. Cl.[4] ..... D01H 5/28; D01H 7/92; D02G 1/04

[52] U.S. Cl. ..... 57/328; 28/273; 57/333; 57/350

[58] Field of Search ..... 57/5, 350, 328, 315, 57/333; 28/271–276

[56] References Cited

U.S. PATENT DOCUMENTS

| | | | |
|---|---|---|---|
| 3,822,543 | 7/1974 | Edagawa et al. | 57/328 X |
| 4,112,658 | 9/1978 | Morihashi | 57/328 |
| 4,183,202 | 1/1980 | Morihashi | 57/328 |
| 4,457,130 | 7/1984 | Sakai et al. | 57/328 |
| 4,495,757 | 1/1985 | Dimitrov | 57/5 |
| 4,569,193 | 2/1986 | Anahara et al. | 57/328 |
| 4,642,978 | 2/1987 | Noda | 57/328 |

FOREIGN PATENT DOCUMENTS

| | | |
|---|---|---|
| 0121602 | 10/1984 | European Pat. Off. . |
| 2727091 | 3/1980 | Fed. Rep. of Germany . |

*Primary Examiner*—John Petrakes

*Attorney, Agent, or Firm*—Barnes & Thornburg

[57] ABSTRACT

In the case of an arrangement for pneumatic false-twist spinning having an intake nozzle and having a false-twist nozzle, it is provided that air guiding means are connected to the intake nozzle that discharge outgoing air of the intake nozzle that is first directed toward the false-twist nozzle, with at least one flow component that is directed against the transport direction of the sliver.

22 Claims, 2 Drawing Sheets

ARRANGEMENT FOR PNEUMATIC FALSE-TWIST SPINNING

BACKGROUND AND SUMMARY OF THE INVENTION

The invention relates to an arrangement for pneumatic false-twist spinning, having means for feeding a drawn sliver, having an intake nozzle, having a false-twist nozzle and having means for withdrawing a spun yarn, in which case means for the discharge of the outgoing air of the intake nozzle are provided between the intake nozzle and the false-twist nozzle.

In the case of a known arrangement described in German Patent (DE-PS) No. 27 27 091, the intake nozzle that is developed as a false-twist nozzle, and the false-twist nozzle that follows are arranged at a distance from one another. They are arranged inside a joint housing, at which, behind the intake nozzle as well as behind the false-twist nozzle, suction lines are connected. This has the purpose of removing occurring blown-off fuzz. In the case of this arrangement, there is the danger that between the intake nozzle and the false-twist nozzle, not only blown-off fuzz is sucked off, but also useful fibers that would then be lost to the spinning process. This results in count fluctuations of the spun yarn. This danger would be particularly high when the intake nozzle exercises no or only a slight twisting effect on the sliver and essentially is used only for a loosening-up of the sliver and a forcing-apart of the fiber ends that, in the false-twist nozzle that follows, are then wound around the sliver.

An arrangement is also known (EP-A No. 121 602) in which only one false-twist nozzle is provided, the conical inlet area of which is to have the effect of an intake nozzle. In the case of this construction, an enlarged expansion space exists between the tapering inlet area and the false-twist nozzle, an air intake means being connected to said expansion space. In order to prevent that fiber deposits occur in this expansion space, it is also provided that this annulus is acted upon by scavenging air that, if necessary, is supplied in the form of compressed air.

An object of the invention is to provide an arrangement of the initially mentioned type in which the intake nozzle can serve essentially as a means for the loosening-up and processing of the sliver, without the danger that fiber losses occur by means of the discharge of the outgoing air of the intake nozzle. This objective is achieved according to the invention by the fact that air guiding means are connected to the intake nozzle that discharge the outgoing air of the intake nozzle that is first directed toward the false-twist nozzle, with at least one flow component that is opposed to the transport direction of the sliver.

In the case of this development, the fact is utilized that the sliver and also possibly loose fibers do not follow an abrupt turning-around of the outgoing air of the intake nozzle so that the sliver and also loose fibers reach the false-twist nozzle securely, while, on the other hand, the outgoing air of the intake nozzle is discharged in such a way that it does not interfere with the operation and the air management of the false-twist nozzle that follows.

Other objects, advantages and novel features of the present invention will become apparent from the following detailed description of the invention when considered in conjunction with the accompanying drawings.

DETAILED DESCRIPTION OF THE DRAWINGS

Figure 1:
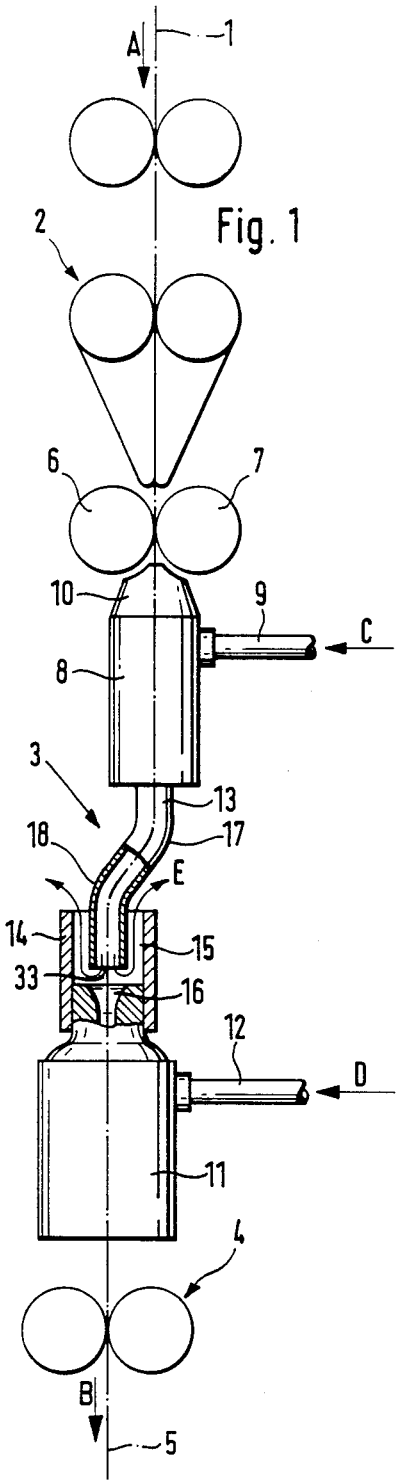
FIG. 1 is a diagrammatic representation of an arrangement constructed according to a first preferred embodiment of the invention, in which the outgoing air of the intake nozzle flows out into the atmosphere.

The arrangement shown in FIG. 1 contains a drawing or drafting roller arrangement 2 to which a sliver 1 is fed in the direction of the arrow A. The sliver 1 is drawn in the drafting roller arrangement 2 to the desired yarn count. Subsequently, the sliver 1 passes through a pneumatic false-twisting zone 3 to which a withdrawal device 4 is connected that is developed as a pair of withdrawal rollers. The yarn 5 that is spun from the sliver 1 is subsequently transported in the direction of the arrow B, to a wind-up device that is not shown, in which it is wound onto a spool. The yarn 5 may be strengthened by means of the pneumatic false-twisting, to such an extent that it can be further processed as a single yarn. However, it is also contemplated to only prestrengthen the sliver 1 by means of the pneumatic false-twisting, so that the withdrawn yarn 5 does not yet have a stability that would be sufficient for a further processing. This type of only prestrengthened yarn will then be strengthened further in a following work step, in which case, for example, a true twist is superposed on it. Naturally, other further treatments are also contemplated, such as twining spinning or twisting-together, in which two yarns that were prestrengthened in this way are twisted together.

Figure 4:
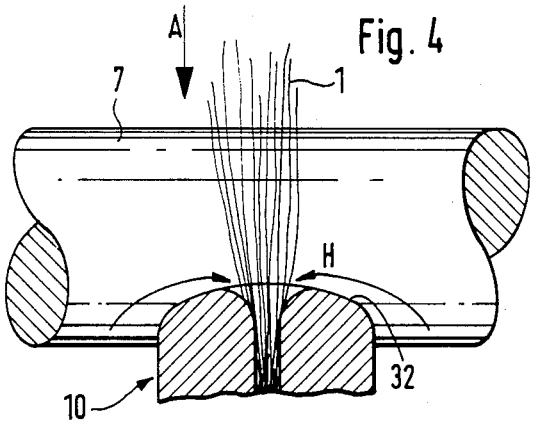
FIG. 4 is an enlarged detail representation of the inlet area of the intake nozzle of embodiments constructed according to FIGS. 1 to 3.

Behind the pair of delivery rollers 6, 7, a first air nozzle is directly connected that is developed as an intake nozzle 8. This intake nozzle 8 is connected to a compressed-air line, via which, from a compressed-air source that is not shown, compressed air is supplied in the direction of the arrow C. On its inside, the intake nozzle 8 has a duct into which several nozzle openings lead that are sloped in transport direction. By means of these air nozzles, no or at the most only a slight twisting effect is imparted to the sliver 1. The intake nozzle 8 has an inlet part 10 that is shown enlarged in FIG. 4. This inlet part 10 has an essentially wedge-shaped outer contour and projects into the wedge-shaped gap formed by the pair of delivery rollers 6, 7 in order to avoid fiber losses at this point. The inlet part 10 has a funnel-shaped inlet opening for the sliver 1. In order to facilitate the entry of air, it is convexly curved (surface 32) in longitudinal direction of the wedge-shaped gap of the pair of delivery rollers 6, 7, so that in the direction of the arrow H, a lateral entry of air is facilitated.

The intake nozzle 8 is followed by a false-twisting nozzle 11 that is also connected with a compressed-air source that is not shown, via a supply line 12, via which compressed air is supplied in the direction of the arrow D. The false-twist nozzle 11 has a passage duct into which several nozzle openings lead which themselves are directed tangentially to the passage duct and in addition may have a slope in transport direction of the sliver 1. False-twist nozzles 11 as well as intake nozzles 8 of the type generally described are known on the basis of the state of the art in multiple forms, so that special forms do not have to be discussed here in detail.

At the outlet of the intake nozzle 8, an air guiding tube 13 is connected that at the same time also serves as a sliver guiding tube. This air guiding tube 13 is aligned in such a way that it directs the outgoing air of the intake nozzle 8 at the inlet opening 16 of the false-twist nozzle 11. The mouth area 33 of the air guiding tube 13 is surrounded by another guiding tube 14 that is mounted at the false-twist nozzle 11 and that forms an annulus 15 together with the end area of the air guiding tube 13. In this annulus 15, the outgoing air of the intake nozzle 8 that comes out of the air guiding tube 13 is discharged against the transport direction of the sliver 1, in the direction of the arrows E into the atmosphere. The sliver 1 and fibers that may be detached from it do not follow this abrupt turning-around of the outgoing air of the intake nozzle 8, so that the sliver 1 and also loose fibers securely arrive in the inlet opening 16 of the false-twist nozzle 11 and thus also further into the false-twist nozzle 11 and are again bound into the sliver 1.

As shown in FIG. 1, the intake nozzle 8 and the false-twist nozzle 11 are not aligned. In contrast, they are offset with respect to one another. This offsetting is balanced by the air guiding tube 13 that forms two deflecting points 17 and 18. In deviation from the only diagrammatic representation of FIG. 1, the sliver 1, in the area of the deflecting points 17, 18, rests against the inner walls of the air guiding duct 13, so that these deflections act as a sort of twist brake, by means of which the returning of the false twist that was applied to the sliver 1 in the false-twist nozzle 11, into the area of the intake nozzle 8 is reduced.

In the following described embodiments of FIGS. 2 and 3, components that correspond to the components according to FIG. 1 are provided with the already used reference numbers, so that these parts do not have to be described again.

Figure 2:
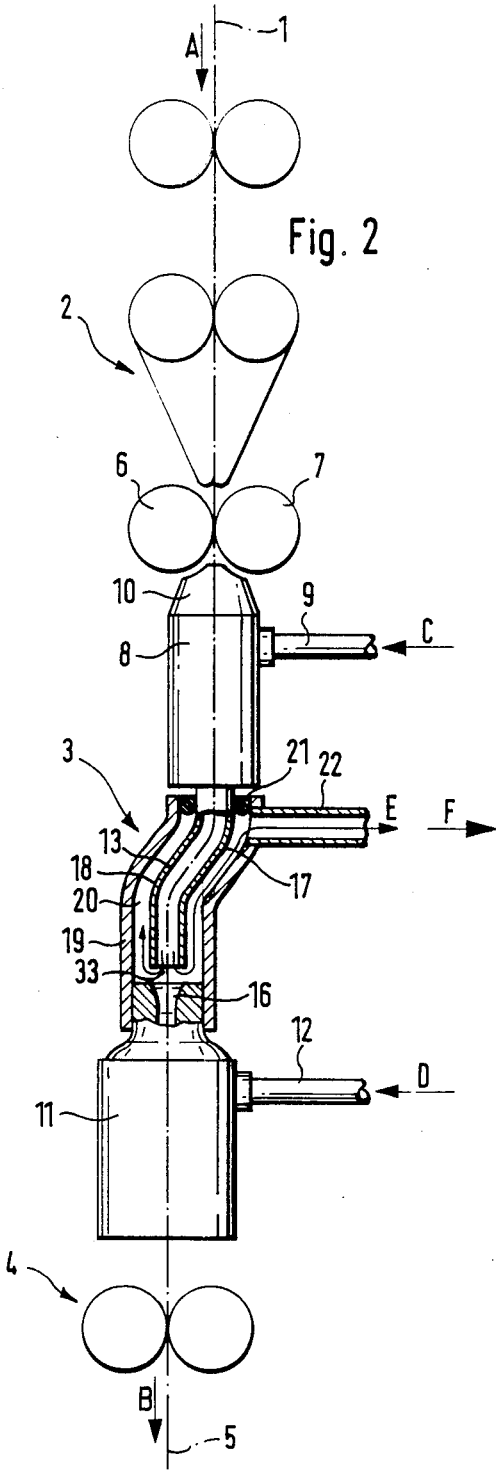
FIG. 2 is a diagrammatic representation of an arrangement constructed according to a second preferred embodiment of the invention that is similar to the embodiment of FIG. 1, but in which the outgoing air of the intake nozzle is sucked off.

In the case of the embodiment according to FIG. 2, an air guiding tube 19 is connected in front of the false-twist nozzle 11. This air guiding tube 19 almost completely surrounds the air guiding tube 13, and in the area of the end that faces away from the false-twist nozzle 11, is sealed off by means of a sealing ring 21 against the air guiding tube 13 toward the outside. In this area, a suction pipe 22 is connected to the outer air guiding duct 19 that forms an annulus 18 with the air guiding duct 13. Suction pipe 22, is connected to a vacuum source in a way that is not shown in detail, by means of which an air current is generated in the direction of the arrow F. The outgoing air of the intake nozzle 8 that flows out of the mouth area 33 of the air guiding tube 13 is thus sucked off in the direction of the arrow E. The vacuum that is applied to the suction duct 22 is advantageously proportioned in such a way that almost all outgoing air of the intake nozzle 8 is sucked off, while a sufficient amount of outgoing air remains by means of which an intake effect remains in the area of the inlet opening 16 for the false-twist nozzle 11.

Should individual fibers be sucked off before reaching the inlet opening 16 of the false-twist nozzle 11 via the annulus 20, it is contemplated to collect these fibers and, if necessary, use them again. However, it may be assumed that the amount of fibers of this type is low.

Figure 3:
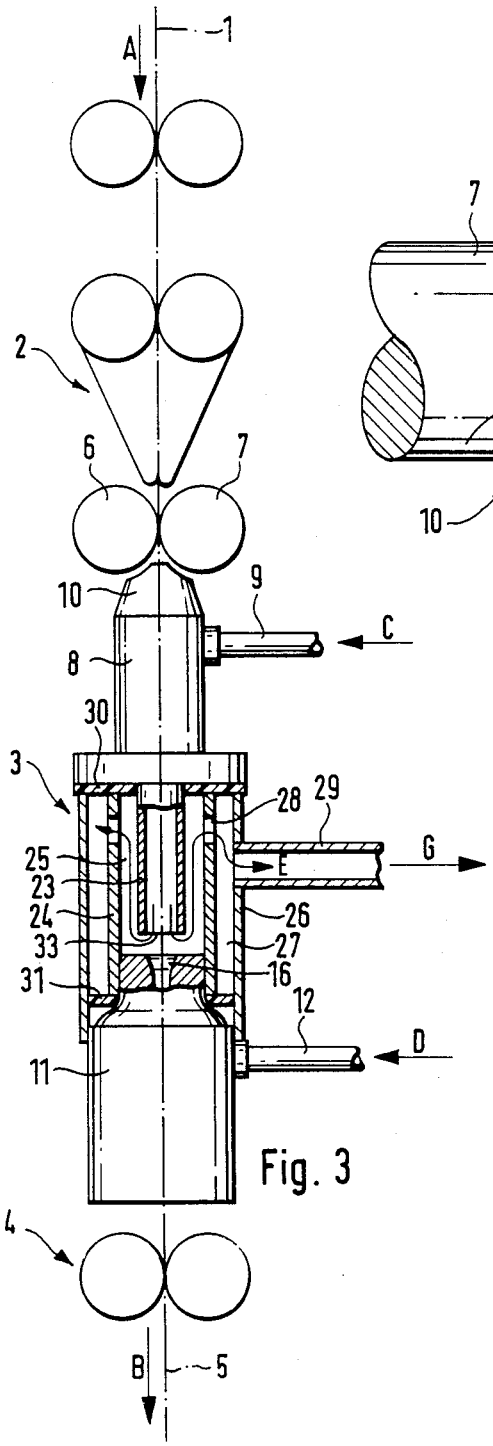
FIG. 3 is a diagrammatic representation of an arrangement constructed in accordance with a third preferred embodiment of the invention that is similar to the embodiments of FIGS. 1 and 2 but with a special development of the suction means for the outgoing air of the intake nozzle.

Also in the case of the embodiment according to FIG. 3, an air guiding tube 23 is connected to the intake nozzle 8, the mouth 33 of this air guiding tube 23 being opposite the inlet opening 16 of the false twist nozzle 11. While forming an annulus 25, this air guiding tube 23 is surrounded by another air guiding tube 24. The air guiding tube 24, with the insertion of sealing disks 30 and 31, is in each case, in a sealing way, connected to the intake nozzle 8 and the false-twist nozzle 11. The air guiding tube 24 is surrounded by another tube 26 forming another annulus 27. This annulus 27 is also sealed off toward the outside, by means of the sealing disks 30, 31. A suction pipe 29 is connected to this tube 26 and is connected with a vacuum source that is not shown and generates an air current in the direction of the arrow G. The air guiding duct 24, in the area that faces away from the inlet opening 16 of the false-twist nozzle 11 and from the mouth 33 of the air guiding tube 23, is equipped with several discharge openings 28 distributed on its circumference, via which the outgoing air of the intake nozzle 8 is sucked off in the direction of the arrows E. By means of the additional annulus 27 and the outgoing-air openings 28 distributed on the circumference, it is possible to achieve a discharge of the outgoing air of the intake nozzle 8 that is distributed evenly over the whole area of the mouth 33. Also in the case of this embodiment, the suction air amount is proportioned in such a way that the air management of the false-twist nozzle 11 is not disturbed.

In the case of the embodiment according to FIG. 3, the intake nozzle 8 and the false-twist nozzle 11 are in alignment, so that also the air guiding tubes 23 and 24 extend in a straight line. An arrangement of this type is also contemplated in the case of the embodiments according to FIGS. 1 and 2, as it is also contemplated in the case of the embodiment according to FIG. 3 to provide a bent course for the air guiding tubes 23 and 24 and also for the outer tube 26.

It should be pointed out explicitly that it is not necessary to provide separate air guiding tubes 13, 14, 23, 24, but that the same function can also be carried out by a corresponding shaping of parts of the intake nozzle 8 and of the false-twist nozzle 11 according to other contemplated embodiments of the invention.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An arrangement for pneumatic false-twist spinning comprising:

sliver feeding means for feeding a drafted sliver;

intake nozzle means for accepting the drafted sliver, said intake nozzle means being supplied with compressed air for transporting the drafted sliver therethrough in a sliver transport direction;

false twist nozzle means arranged after the intake nozzle means in the sliver transport direction for accepting sliver from the intake nozzle means, said false-twist nozzle means being supplied with compressed air for transporting the sliver and applying a twist thereto; and air discharge means provided between the intake nozzle means and the false-twist nozzle means for discharging intake nozzle outlet air flowing out of the intake nozzle means;

wherein said air discharge means includes air guiding means for deflecting at least a portion of the intake nozzle outlet air to flow back against the sliver transport direction as the sliver travels into an inlet opening of the false-twist nozzle means.

2. An arrangement according to claim 1, wherein the air guiding means includes means for deflecting the intake nozzle outlet air in an area closely in front of the false-twist nozzle means by about 180°.

3. An arrangement according to claim 1, wherein said air guiding means includes a guide tube opening toward the intake nozzle means, wherein a sliver guiding tube is connected to the intake nozzle means, said sliver guiding tube extending into the guide tube with an annulus formed between outside walls of the sliver guiding tube and inside walls of the guide tube, said annulus including an air outlet opening means spaced from an outlet end of the sliver guiding tube in a direction opposite the sliver transport direction.

4. An arrangement according to claim 3, wherein the annulus is open in the direction of the atmosphere.

5. An arrangement according to claim 3, wherein the annulus is sealed off with respect to the atmosphere and is connected with a suction line.

6. An arrangement according to claim 3, wherein outer tube means are disposed around the guide tube with formation of an outer annulus between the outer tube means and guide tube, wherein suction pipe means are connected to the outer annulus, and wherein the guide tube is equipped with several air outlet opening means including air outlet openings distributed over its circumference, said air outlet openings leading into the outer annulus.

7. An arrangement according to claim 3, wherein the sliver guiding tube has at least one bend in the area of which the passing-through sliver is deflected.

8. An arrangement according to claim 3, wherein the intake nozzle means has an inlet part that has an essentially wedge-shaped outer contour for projecting into the area of a wedge-shaped gap of a pair of delivery rollers of a drafting roller means.

9. An arrangement according to claim 1, wherein the air guide means includes a sliver inlet guiding tube that is connected in front of the false-twist nozzle means and is equipped with several air outlet openings distributed over its circumference, said air outlet openings leading into an outer annulus that is connected with a suction pipe.

10. An arrangement according to claim 9, wherein the sliver inlet guiding tube has at least one bend in the area of which the passing-through sliver is deflected.

11. An arrangement according to claim 1, wherein the intake nozzle means has an inlet part that has an essentially wedge-shaped outer contour for projecting into the area of a wedge-shaped gap of a pair of delivery rollers of a drafting roller means.

12. An arrangement according to claim 1, wherein the air guiding means includes a guide tube that is connected in front of the false-twist nozzle means and is equipped with several air outlet openings distributed over its circumference, wherein an outer tube means connects the air intake nozzle means with formation of an outer annulus surrounding the guide tube, and wherein said air outlet openings lead into the outer annulus.

13. An arrangement according to claim 1, wherein a sliver guiding tube extends between the intake nozzle means and adjacent to an inlet opening of the false-twist nozzle means for guiding the sliver and the intake nozzle outlet air, said sliver guiding tube having at least one deflecting bend for deflecting the path of the sliver.

14. An arrangement according to claim 1, wherein the air guiding means includes means for deflecting the intake nozzle outlet air in an area closely in front of the false-twist nozzle means by more than 90°.

15. A method of forming yarn by pneumatic false-twisting comprising:

feeding drafted sliver to an intake nozzle means, supplying compressed air to the intake nozzle means for transporting the drafted sliver therethrough in a sliver transport direction, guiding the drafted sliver from the intake nozzle means to false-twist nozzle means, having an inlet opening, supplying compressed air to the false-twist nozzle means for transporting the drafted sliver and applying a twist thereto, and discharging intake nozzle outlet air flowing out of the intake nozzle means, wherein said discharging air includes deflecting at least a portion of the intake nozzle outlet air to flow back against the sliver transport direction adjacent a location where said sliver travels into the inlet opening of the false-twist nozzle means.

16. A method according to claim 15, wherein air guiding means are provided for said deflecting, and wherein the air guiding means includes means for deflecting the intake nozzle outlet air in an area closely in front of the false-twist nozzle means by about 180°.

17. A method according to claim 16, wherein said air guiding means includes a guide tube opening toward the intake nozzle means, wherein a sliver guiding tube is connected to the intake nozzle means, said sliver guiding tube extending into the guide tube with an annulus formed between outside walls of the sliver guiding tube and inside walls of the guide tube, said annulus including an air outlet opening means spaced from an outlet end of the sliver guiding tube in a direction opposite the sliver transport direction.

18. A method according to claim 17, wherein the annulus is open in the direction of the atmosphere.

19. A method according to claim 17, wherein the annulus is sealed off with respect to the atmosphere and is connected with a suction line.

20. A method according to claim 17, wherein the sliver inlet guiding tube has at least one bend in the area of which the passing-through sliver is deflected.

21. A method according to claim 17, wherein outer tube means are disposed around the guide tube with formation of an outer annulus between the outer tube means and guide tube, wherein suction pipe means are connected to the outer annulus, and wherein the guide tube is equipped with several air outlet opening means including air outlet openings distributed over its circumference, said air outlet openings leading into the outer annulus.

22. A method according to claim 16, wherein the air guiding means includes means for deflecting the intake nozzle outlet air in an area closely in front of the false-twist nozzle means by more than 90°.

* * * * *